United States Patent [19]

Niksic et al.

[11] Patent Number: 4,998,552

[45] Date of Patent: Mar. 12, 1991

[54] GEODETIC TENT STRUCTURE

[75] Inventors: Mark R. Niksic, Lakewood, Colo.; Mark E. Erickson, Oakland, Calif.

[73] Assignee: T. A. Pelsue Company, Englewood, Colo.

[21] Appl. No.: 406,233

[22] Filed: Sep. 12, 1989

[51] Int. Cl.[5] ..... E04H 15/36

[52] U.S. Cl. ..... 135/102; 135/104; 135/106; 52/81

[58] Field of Search ..... 135/101, 102, 106, 104, 135/97, 109, 115; 52/80, 81, 646

[56] References Cited

U.S. PATENT DOCUMENTS

| | | | |
|---|---|---|---|
| 2,716,993 | 9/1955 | Codrick | 135/103 |
| 2,781,767 | 2/1957 | Blankenship, Jr. | 135/109 |
| 3,006,670 | 10/1961 | Schmidt | 135/106 X |
| 3,059,658 | 10/1962 | Finlayson | 135/109 |
| 3,197,927 | 8/1965 | Fuller | 52/81 |
| 3,502,091 | 3/1970 | Corbin | 135/97 |
| 3,766,932 | 10/1973 | Sidis et al. | 135/97 X |
| 3,888,056 | 6/1975 | Kelly et al. | 52/81 X |
| 4,241,746 | 12/1980 | Rothe | 135/106 X |
| 4,262,461 | 4/1981 | Johnson et al. | 52/646 X |
| 4,265,259 | 5/1981 | Gillis | 135/115 X |
| 4,703,594 | 11/1987 | Reber | 52/81 |
| 4,750,509 | 6/1988 | Kim | 135/102 |

FOREIGN PATENT DOCUMENTS

| | | | |
|---|---|---|---|
| 0222437 | 5/1987 | European Pat. Off. | 52/81 |
| 1609341 | 2/1978 | Fed. Rep. of Germany | 52/81 |
| 1255636 | 11/1969 | United Kingdom | 52/81 |

*Primary Examiner*—David A. Scherbel
*Assistant Examiner*—Lan Mai
*Attorney, Agent, or Firm*—Richard W. Hanes

[57] ABSTRACT

A self supporting collapsible tent structure having a tension bearing polygonal shaped floor member defining a first tent level, a plurality of hub members each carrying a plurality of sockets which are pivotal about axes which are co-planer and are interrelated one to the other as the sides of polygon, a series of said hub members disposed in a plane at a second tent level which is spaced apart from said first tent level and whose sockets are pivotal in a first direction, and additional series of said hub members disposed in a plane at a third tent level which is spaced apart from said second tent level and whose sockets are pivotal in a second direction, opposite to the said first direction, a single, apex forming hub member disposed at a fourth tent level and whose sockets are pivotal in said first direction, a first plurality of compression rods, the ends of which are seated in the said sockets of the hub members in slightly curved polygonal planes defined and bounded by the rod members and a second plurality of compression rods, one end of which are seated in sockets of the hub members at the second tent level and the other end of which are connected to the perimeter of the floor member.

4 Claims, 5 Drawing Sheets

Fig_16
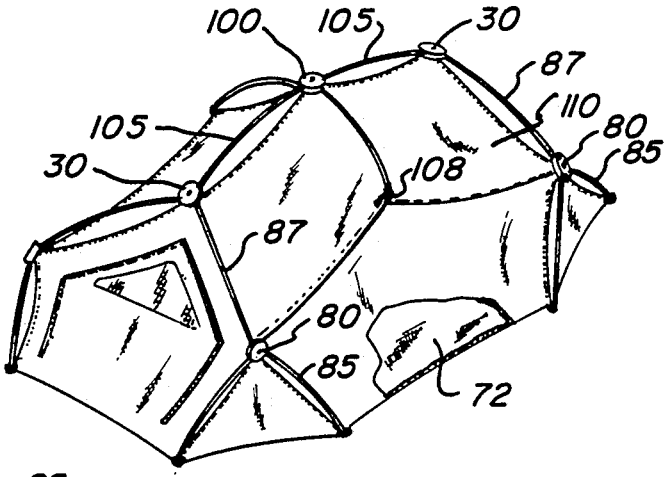
Fig_17
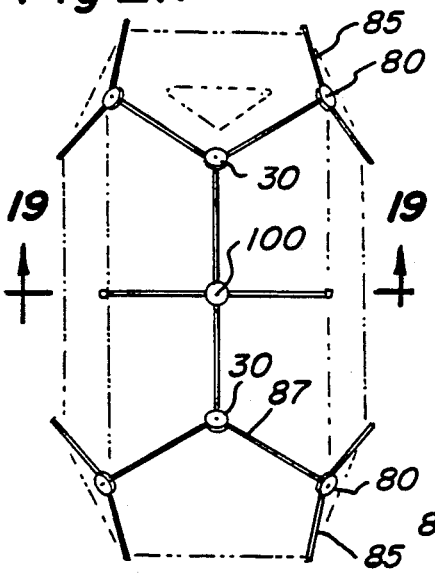
Fig_19
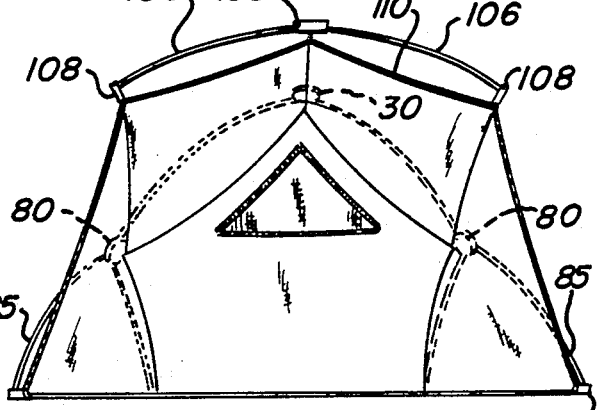
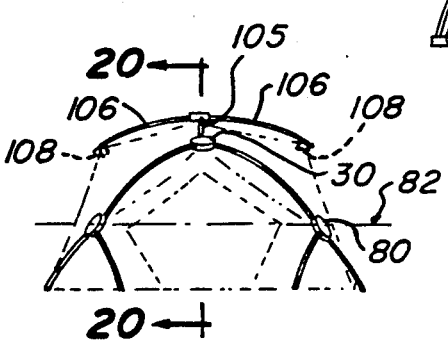
Fig_18
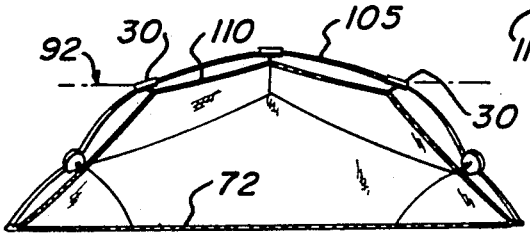
Fig_20

GEODETIC TENT STRUCTURE

The present invention relates to reticular self-supporting tent frames and structures and more particularly to one comprising light-weight structural rods which are assembled and disassembled around a series of outlinearly disposed hubs, forming a dome-shaped structure to which is attached a tent skin.

BACKGROUND OF THE INVENTION

Tents having frame members which are assembled from a series of rods carried in the pivotal sockets of a number of hubs are not new per se. A number of United States and foreign patents have issued on such generic structures. One of those patents which, it is believed, represents the closest prior art to the present invention is U.S. Pat. No. 3,766,932. That patent discloses a three-dimensional collapsible structure formed by an array of bar-like elements each pivotally connected at its ends to one or more other such elements. The primary object of that disclosure seems to be true collapsibility; however, if the description of the invention is followed closely with the drawings, it would appear that the object is unattainable and the structure depicted in FIGS. 1 and 2 of the patent cannot be collapsed into the package shown in FIG. 8. Furthermore, the perametric rods forming the bottom portion of the tent frame make contact with the ground at spaced apart points, leaving elevated triangular shaped spaces to be filed by angulation of the tent floor, wasting floor space. Because the frame is apparently intended to be totally self-supporting without the tent skin, the disclosure makes no reference as to how the skin is applied or supported. Because the skin is not a structural element, the frame portion is necessarily more complex than it needs to be because it is apparently made to be self-supporting without the use of compression members to achieve bending and self-support, as in the present invention.

The patents discussed in the specification of the above mentioned patent, including the British Patent 1,009,371, are relevant to the instant disclosure but do not anticipate its simplicity, ease of operation and structural integrity. Other U.S. patents which disclose frames of the same general type are: Nos. 3,502,091; 2,716,993; 2,781,767; 3,059,658 and 3,197,927.

As seen from the complexity and doubtful utility of the prior art, it is the primary object of the present invention to provide a tent structure which includes a free-standing frame and a structurally cooperative floor which can be collapsed into a compact package whose length is equivalent to the length of the individual compression rods forming the structure.

A second object of the invention is to provide one species of the generic tent frame structure which has the optimum volume characteristics of a substantial hemisphere.

A still further object of the invention is to generically provide a structure whose floor plan can vary but the constance of the principal design characteristic of alternate level reverse articulation will always produce a structure which will be collapsible in the manner of the first objective.

Another object of the invention is to provide a structure conforming to geometries based on polyhedra which are not limited to 2n sides, but on the other hand may be triangles or pentagons to provide flexibility of design.

Other and still further objects, features and advantages of the invention will become apparent upon a reading of the following detailed description of a preferred and one alternate form of the invention, taken in conjunction with the accompany drawings in which.

Figure 11:
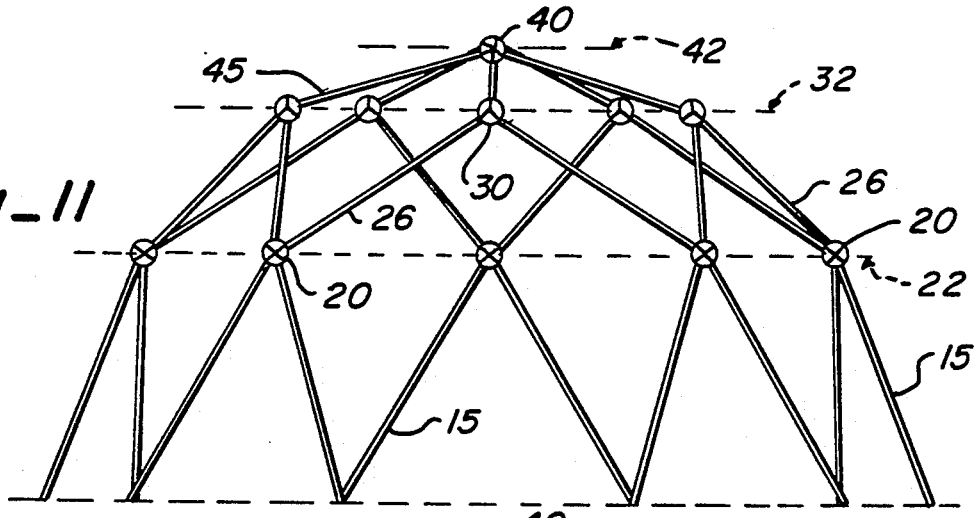

FIG. 11 is a diagrammatic side elevational view of the erected frame of the tent structure of the present invention with the three-rod hubs shown as circles enclosing a "Y" and the four-rod hubs shown as a circle enclosing an "X". The figure is diagrammatic because it is shown without the framing rods being bowed in order to demonstrate the collapsibility of the structure in the following FIGS. 12 through 15.

Figure 12:
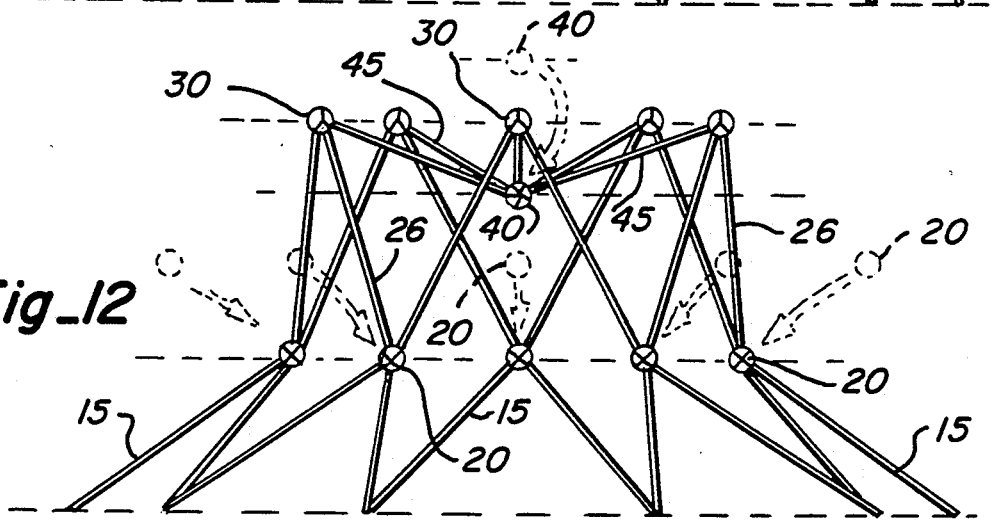

FIG. 12 is a side elevational view showing the frame structure (without the covering skin, for clarity) in the first stage of collapse.

Figure 13:
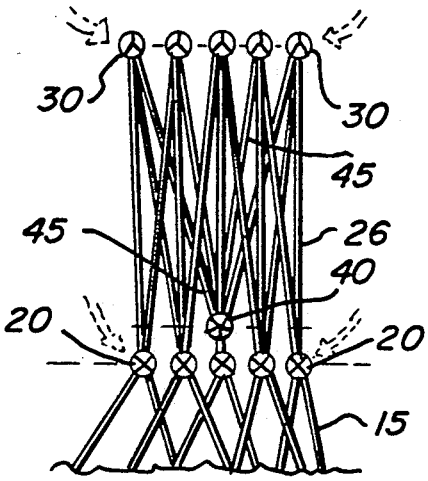

FIG. 13 is a side elevational view showing the frame structure in an advanced stage of collapse with the lower framing rods shown fragmentarily.

Figure 14:
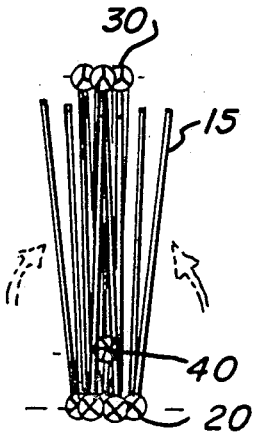

FIG. 14 is a side elevational view of the frame structure showing the lower-most framing rods, which were fragmentarily shown in FIG. 13, as being folded upwardly to become parallel with the other framing rods.

Figure 15:
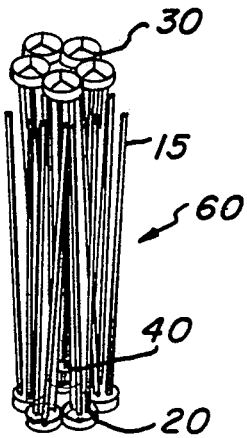

FIG. 15 is a perspective view of the collapsed tent framing structure.

FIG. 16 is a perspective view of a second embodiment of the tent structure of the present invention, or an elongated floor plan or two-person tent.

FIG. 17 is a top plan view of the two-person tent frame showing the covering skin on the front and rear panels in dashed lines and showing the second and third level planes or levels of the tent structure in dashed lines.

FIG. 18 is an end view of the second embodiment with the tent skin shown in dashed lines.

FIG. 19 is a cross-sectional view taken along lines 19—19 of FIG. 17.

FIG. 20 is a cross-sectional view taken along lines 20—20 of FIG. 18.

SUMMARY OF THE INVENTION

The present invention is a novel structural design which is primarily suited for temporary use, but is not necessarily so limited. It is a structure which is preferably collapsible so as to be compressed into a relatively small package when not in use or for transport. The structure is one which will usually take on the characteristics of a tent, that is, it is portable, collapsible and provides cover for its interior space with a fabric or plastic skin.

A tent forming skin is supported by a geodesically-formed reticular arrangement of framing rods which, with their interconnecting hub members, define triangles, tetragons and pentagons forming a self-supporting polyhedral frame. The framing rods are in compression, forming a series of bowed elements radiating from each hub and which together create an enclosure which is stabilized by constraining the perimeter of the frame from outward movement at its lowest level. This constraint may conveniently come from a tensioned floor member to which are attached the lowest points of the frame, but the constraint could come from staking the frame members to the ground or surrounding the lower portion of the total frame with a ring or collar.

To permit purposeful collapse of the structure, which is important to its transportability in a temporary use situation, the framing rod connecting hubs are located at distinct levels or, said differently, located within different horizontal planes which are spaced from the ground level. All of the hubs in one level provide for pivotal movement of the rods which are mounted in those hubs in a given direction. All of the hubs in an adjoining level, or plane, provide for the pivotal movement of the rods which those hubs carry in an opposite direction to that of the hubs of the next preceding adjoining level.

Many different levels may be provided, depending on the size of the structure which it is desired to create and depending on the design limits of the length of the rods used in the framing of the structure. Regardless of the number of levels, the pivoting action of the hubs in one level is opposite in direction to the pivoting action of the hubs in the adjoining levels on each side of it.

DETAILED DESCRIPTION

One embodiment of the tent structure of the present invention is shown erected in FIGS. 1 through 4, where the tent 10 appears substantially as a "hemisphere" of a twenty-eight sided polyhedron.

The total structure includes a tent floor 12 which is an integral part of the tent structure, being a pliant or foldable material which, in this embodiment, is shaped as a decagon. (See FIG. 3) Attachable to the floor 12 at the angle points 12*a* of the decagon are a plurality of slender light-weight rods 15 which are sized and dimensioned to tolerate compressive loads and to bend or flex in the process of being compressed. One end of each of the rods 15 may be inserted into a tab 17 attached to the floor at an angle point. (See FIG. 2) The other end of the rods 15 are seated in the pivotal sockets 19 of hub members 20.

The hub members 20, and the other hub members to be referred to later, are all of a similar type and are not generically unlike the hub disclosed in U.S. Pat. Nos. 3,810,482 and 4,637,748. They essentially comprise a base member 21 which mounts a plurality of sockets 19 which are pivotally mounted for rotation about axes which are interrelated one to another as the sides of a polygon. That is to say, in a plan view of one of the hubs, the various axes of the respective sockets 19 would interconnect to form a polygon, the number of sides of which would depend on the number of sockets carried by the hub.

Figure 9:
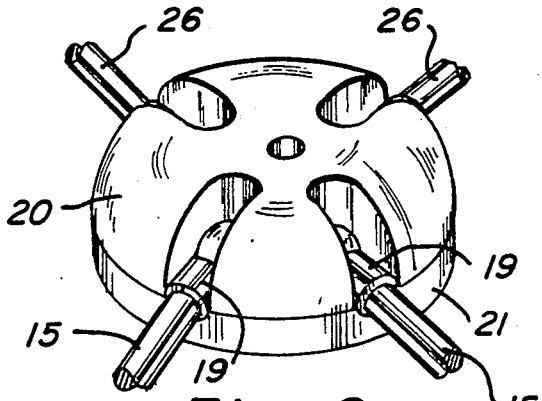
FIG. 9 is a perspective view of a four-rod connecting hub, employed at the second level of the tent structure. The rods are shown in their radial, extended or erected position.
Figure 10:
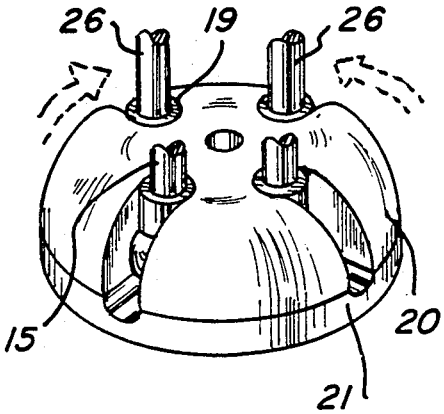
FIG. 10 is similar to FIG. 9 except that the rods are shown in their or packaged position.

The hub 20 in the preferred form of the invention, shown in FIGS. 1 through 4, 9 and 10, has four sockets 19 spaced apart from each other so that there are two acute angles and two obtuse angles between the longitudinal axis of each of the sockets with the sockets splayed radially in the erected position, as shown in FIG. 9. The several socket axes of each hub are in the same plane and a plan view of these axes would represent in FIG. 9 an irregular tetragon, or in FIG. 7 a triangle.

The length of the rods 15 are equal to each other in order that all of the hubs 20 will lay in a common plane 22 which is parallel to the essentially flat floor member 12. (See FIG. 4) If the floor is referred to as a first level of the tent, then the plane occupied by the hubs 20 may be referred to as the second tent level 22.

Each of the hubs 20 carry in their respective pivotal sockets 19 two rods 15 which are attached to the floor 12 of the tent 10, as previously explained, and each of the hubs 20 carry two other rods 26 whose distal ends are disposed in the sockets of another series of hubs 30, all of which are disposed within a higher plane, which is also parallel to the floor 12, and may be referred to as the third tent level 32.

Figure 7:
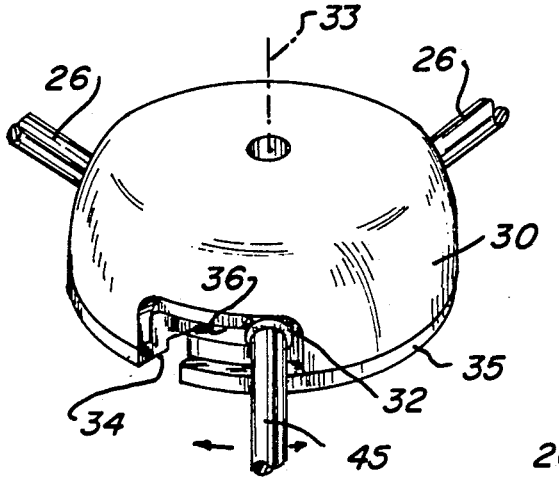
FIG. 7 is a perspective view of a three-rod connecting hub, employed at the third level of the tent structure. The rods are shown in extended or erected position.
Figure 8:
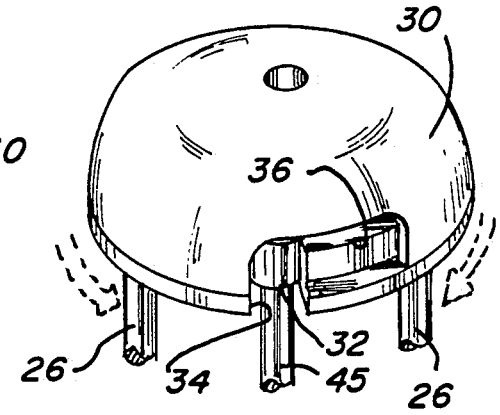
FIG. 8 is similar to FIG. 7 except that the rods are shown in their or packaged position.

The hubs 30 are similar in general construction to the hubs 20 in the second tent level, except each of these hubs carry three sockets 32 whose respective axes form a plane equilateral triangle. The hubs 30 are distinct from the hubs 20 and the single hub 40, to be later described, in one significant aspect. The direction of the bending moment of the rods 26 and 45, when the rods are in compression, is in the same direction as is the pivotal movement of the rods made necessary to collapse the structure. In order to accommodate the bending moment when in the erected position, the rod receiving sockets 32 are mounted internally of the hub so as to rotate about the central axis 33 of the hub from a first position aligned with the vertical slot 34 in the base 35 to a second position within a horizontal channel 36 in the hub housing. In the rotated second position, as shown in FIG. 7, the base 35 supports the rod 45 or 26 against the bending force imposed by the compression forces on the rods. When the rods are rotated to the slot end of the channel, they are free to rotate about their pivotal axes to assume the stored position, as shown in FIG. 8. Rods 26, similar in construction to the first set of rods 15, interconnect those hubs 30 on the third tent level with the hubs 20 on the second tent level. Two divergent rods 26 carried by one hub 30 interconnect with two adjacent hubs 20 on the second level.

Forming the apex of the tent structure at a fourth tent level 42 is a single five-socket hub 40 which is interconnected with the hubs 30 on the adjacent and next lower tent level 32 by a plurality of similar compression rods 45.

Figure 1:
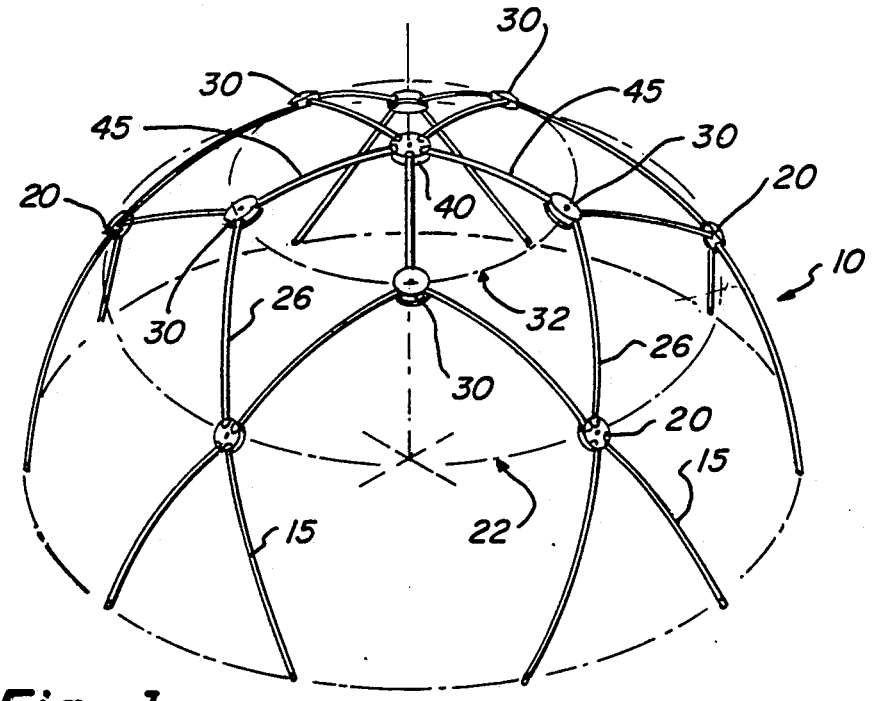
FIG. 1 is a perspective view of the tent frame of the present invention shown without the covering skin.
Figure 2:
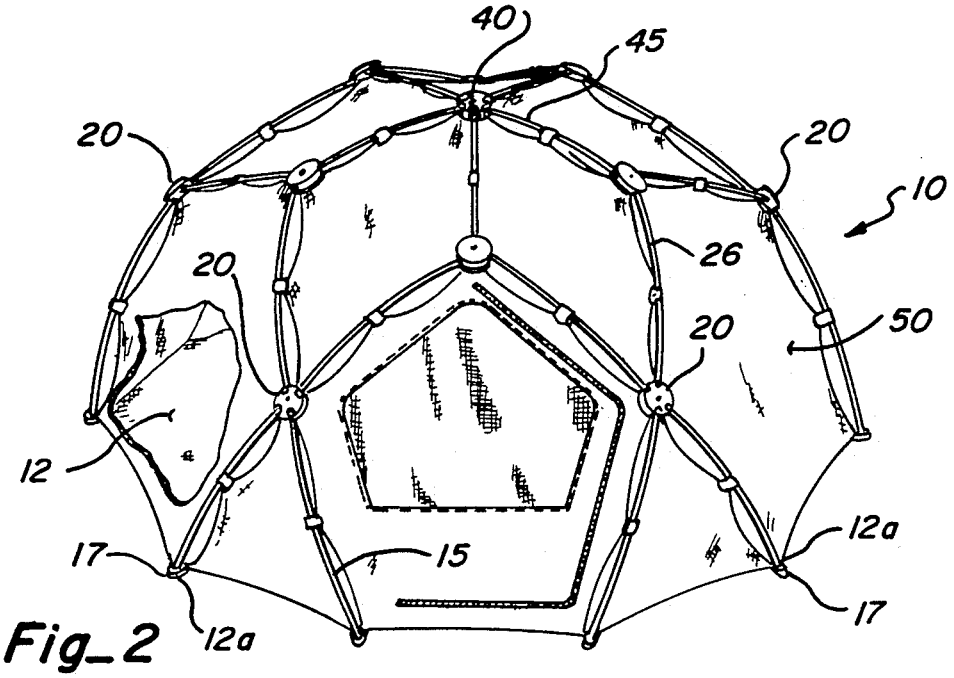
FIG. 2 is a view similar to that of FIG. 1, including the tent skin, a portion of which is broken away to reveal the floor member of the tent which is structurally attached to the lower-most portion of the supporting frame.
Figure 3:
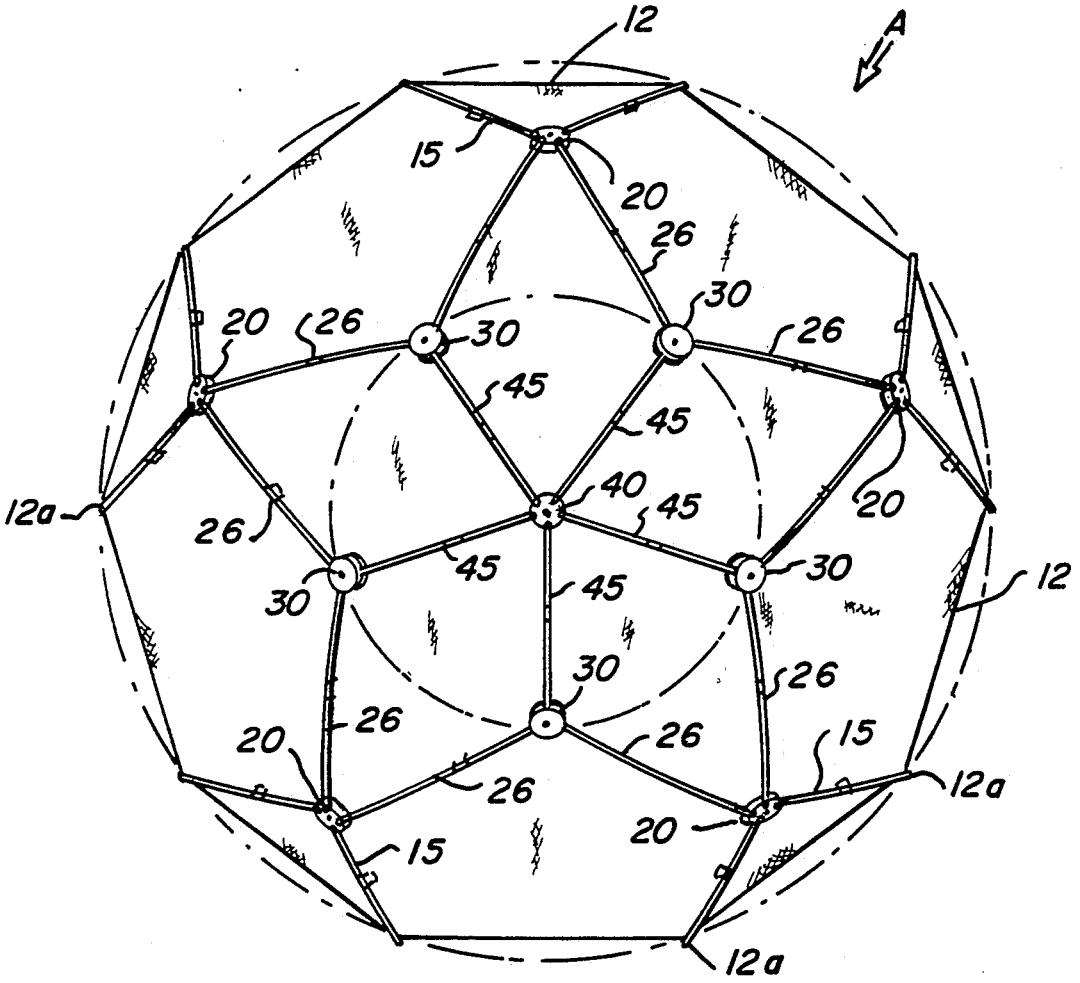
FIG. 3 is a top plan view of the tent frame structure of the prevent invention diagrammatically showing the tent floor as a decagon.
Figure 4:
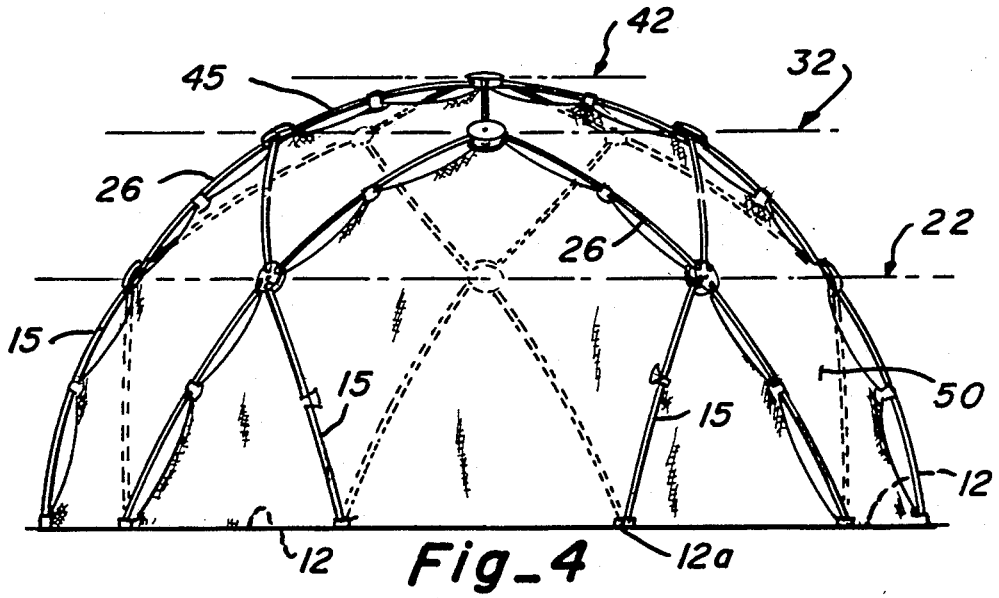
FIG. 4 is a quartering rear elevational view of the tent of the present invention looking in the direction of the arrow "A" in FIG. 3.
Figure 5:
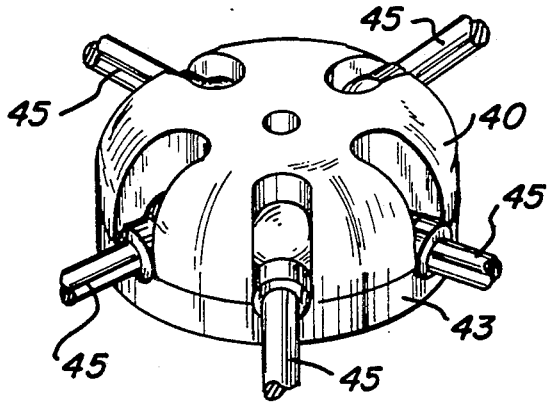
FIG. 5 is a perspective view of a five-rod connecting hub, employed at the fourth level apex of the tent structure. The rods are shown in radial, extended or erected position.
Figure 6:
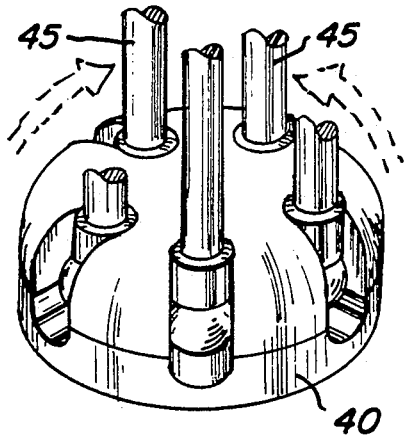
FIG. 6 is similar to FIG. 5 except that the rods are shown in their or packaged position.

FIG. 5 shows the hub 40 with its rods 45 radially disposed. The base 43 of the hub 40 opposes the bending forces in the rods 45 when they are in compression. When the hub 40 is pulled down, and passes through the toggle point or through the over-center point of the compressive rod forces, the rods 45 are free to pivot into the position shown in FIG. 6, for storage and packing of the tent structure. The apex hub 40 carries its five sockets so as to pivot in the same direction, with respect to the supporting base of the hubs, as the sockets of the hubs 20 on the second level 22.

The structure thus far described could easily be fixed, and in such condition would not require that the sockets of each of the hubs be pivotally mounted in the hubs. However, since one of the primary objects of the novel structure being described is that it be collapsible into a compact package the pivotal nature of the socket mountings is necessary.

The packaging scheme of the present invention centers on the pivotal direction of the sockets at each of the various levels of the tent at which the hubs are placed. For purposes of explaining the dismounting or collapsibility of the structure, it will be useful to establish the terminology. The term "outwardly" will be used to mean a direction substantially normal to the geometric planes formed by the interconnecting rods and away from the inside of the tent structure On the other hand, "inwardly" will mean a direction opposite to "outwardly," toward the inside of the tent structure, as shown in dotted lines for hubs 20 and 40 in FIG. 12.

In order to accomplish the proper collapsing of the structure, the hubs 20 on the second level are constructed so that the sockets pivot outwardly, allowing the hubs 20 to move inwardly, drawing each of the pairs of rods 15 and 26 which are carried by a hub 20, together, approaching a mutually parallel relationship with each other.

Conversely, the hubs 30 at the third level 32, oppositely constructed from those at the second level, are drawn outwardly, whereby the attached rods 26 and 45 will be drawn together so as to approach mutual parallelism with each other.

It is seen in the overall then that the tent may be easily collapsed and packaged by first pulling the apex hub 40 inwardly against the compressive force of the rods 45 until the hub passes over the center line connecting the third level hubs 30. After the hub 40 passes over the center line it will fall, the sockets thereon pivoting outwardly to draw the rods 45 together.

As the apex falls inwardly, the level three hubs 30 are pulled outwardly or remain essentially in place and the level two hubs 20 are pushed inwardly as shown in FIG. 12, resulting in a package 60 where all of the rods come together in a parallel bundle taking the tent skin with the rods so as to form a package where the skin is still attached to and packed with the rods to which it is attached when the structure is assembled.

It should be noted that when erected the structure is self-supporting because the rods are all in compression, bowing outwardly to form an integral structure. (See FIG. 4) The compression of the rods, however, is countered by the anchoring of the rods 15 to the floor 12 of the tent. The floor then becomes the tension member of the structure. Other types of devices, such as ground anchors or a circumferential ground level collar disposed around the bottom part of the tent frame could serve the same purpose as the tensioned tent floor. A tent skin 50 is supported by the frame, but is not a structural member.

The size of the structure is limited only by the length of the compression rods which, for a camping type of tent, should be of such length as to be easily storable, the length of the tent in its packaged and dismounted form 60 being essentially the same as the length of the rods.

Other shapes of structures may be built using the principals of the present invention. FIGS. 16 through 20 illustrate a structure 70 Whose floor plan is an elongated irregular octagon. The polyhedron formed by the supporting compression rods in this embodiment is a different shape than that of the preferred form shown in FIGS. 1 through 4, but contains the same multilevel construction of alternately pivotal hub sockets which permit the same kind of disassembly as described above.

A floor 72 acts as the tension member to resist the bending forces of the frame when the frame supporting rods are in compression. The floor 72 forms a first level analogous to the first level of the tent floor 12 in the preferred embodiment of FIGS. 1 through 4. A second level 82 contains four corner hubs 80 which are equivalent in construction to the hubs 20 shown in FIGS. 9 and 10 except that hubs 80 contain three sockets instead of four. The third level 92 of the tent 70 contains hubs 30. The apex, or the fourth level of the tent structure, contains a single hub 100, similar in construction to hub 40 of FIGS. 5 and 6, except that hub 100 accommodates four legs instead of the five legs of hub 40.

The hubs 80 at the second level accommodate one end of rods 85, the other end of which is attached to the tent floor 72. The third level hubs 30 are interconnected to the second level hubs 80 by rods 87. The apex hub 100 supports a pair of rods 105 which interconnect with the third level hubs 30. The hub 100 also supports a pair of radially extending hubs 106, the proximal ends of which are supported by tabs 108 attached to the tent skin 110.

As will be apparent, the structure of tent 70 is collapsible in the same manner as the tent of the preferred embodiment; that is, the apex hub 100 is pulled down through the plane connecting tabs 108 and the hubs 80 are pulled inwardly in the same manner as hubs 20 in the preferred form. The rods interconnecting the ground level floor 72 and the second level hubs 80 are disconnected from their seats 112 on the perimeter of the floor 72 and are folded in the same manner as the rods 15 in the preferred embodiment, illustrated in FIG. 14.

We claim:

1. A self supporting collapsible tent structure comprising:

a planar tension bearing polygonal-shaped floor member having a defined perimeter and comprising a first tent level;

a plurality of hub members each carrying a plurality of sockets which are pivotal about axes which are co-planer and which axes are interrelated one to the other as the sides of a polygon;

a first series of said hub members disposed in a plane at a second tent level which is spaced apart from said first tent level and whose sockets are pivotal in a first direction;

a second series of said hub members disposed in a plane at a third tent level which is spaced apart from said second tent level and whose sockets are pivotal in a second direction, opposite to the said first direction;

an apex-forming hub member disposed at a fourth tent level which is spaced apart from said third tent level and whose sockets are pivotal in said first direction;

a first plurality of compression rods, the ends of which are seated in the said sockets of the hub members, and which interconnect the hub members in polygonal planes defined and bounded by the rod members; and a second plurality of compression rods, one end of which are seated in sockets of the hub members at the second tent level and the other end of which are connected to the perimeter of the floor member.

2. The structure of claim 1 where the floor member has the shape of an octagon.

3. The structure of claim 1 where the floor member has the shape of a decagon and the tent structure is substantially shaped as the hemisphere of a twenty-four sided polyhedron.

4. The combination of claim 1 and further including tent skin means attached to the perimeter of the floor member and secured to the said rods and hub members.

* * * * *